United States Patent [19]

Oseto

[11] 3,985,056

[45] Oct. 12, 1976

[54] MULTIPLE TOOL HOLDING PUNCHING UNIT

[75] Inventor: Moichi Oseto, Hatano, Japan

[73] Assignee: Amada Company Limited, Isehara, Japan

[22] Filed: Mar. 7, 1975

[21] Appl. No.: 556,407

[30] Foreign Application Priority Data

Feb. 17, 1975 Japan ..... 50-8767

[52] U.S. Cl. ..... 83/552; 83/685; 83/698; 408/35

[51] Int. Cl.[2] ..... B26D 5/08; B26F 1/14

[58] Field of Search ..... 83/685, 549, 550, 551, 83/552, 553, 698; 29/26 A; 408/35

[56] References Cited

UNITED STATES PATENTS

| | | | |
|---|---|---|---|
| 1,926,985 | 9/1933 | Podrabsky | 83/552 |
| 2,701,017 | 2/1955 | Wiedemann | 83/552 X |
| 2,748,864 | 6/1956 | Ewaldson et al. | 83/552 X |
| 3,079,824 | 3/1963 | Schott | 83/698 X |
| 3,234,839 | 2/1966 | Smeets | 83/549 |
| 3,449,991 | 6/1969 | Daniels | 83/552 X |
| 3,779,122 | 12/1973 | Sawvell | 83/698 |

*Primary Examiner*—Othell M. Simpson
*Assistant Examiner*—W. D. Bray
*Attorney, Agent, or Firm*—Wigman & Cohen

[57] ABSTRACT

This disclosure relates to a punching apparatus for perforating sheet materials, and comprises a multiple tool holding unit mounted on a press table beneath a vertically movable press ram. The tool holding unit includes a horizontally extending upper arm having a horizontally swingably journalled holding member disposed at the free end thereof. The punch holding member is provided with a plurality of punch holding bores which may be selectively positioned beneath the press ram whereby holes of different diameter may be punched in the sheet material. The punching unit further includes a lower arm disposed beneath the horizontally extending upper arm, and includes a die holding bore having the configuration of two half circles connected with each other by two parallel lines running in the same horizontal direction as the lower arm and is further provided with a horizontally movable clamping member.

8 Claims, 5 Drawing Figures

MULTIPLE TOOL HOLDING PUNCHING UNIT

BACKGROUND OF THE INVENTION

1. Field of the Invention

The present invention relates generally to a punching unit for perforating sheet metals and other sheet materials and pertains more particularly to a multiple tool holding unit which can hold various punches and dies, both large and small, to be used with presses.

2. Description of the Prior Art

It is well known that perforating sheet materials such as sheet metals is carried out by a punching unit which has a punch or upper tool and a die or lower tool and is mounted on the table of a press just beneath the ram thereof. A typical type of the conventional punching unit is of a gnerally C-shaped construction which has an upper arm for holding the punch or upper tool and a lower arm for holding the die or lower tool and forms between the upper and lower arms a throat or opening into which the material to be perforated is to be inserted. Since punches and dies for punching holes of a certain range of sizes are so constructed that their portions to be held by the punching unit are all equal in size and shape, the punching unit can hold different punches and dies for punching holes of a certain range of sizes to be used to punch as wide a range of holes in size as possible.

It has been, however, a serious disadvantage with the conventional punching unit that the range of sizes of holes to be punched thereby is limited. It is, therefore, necessary to provide a larger punching unit for punches and dies for punching larger holes and a smaller one for punches and dies for smaller holes. Accordingly, it has been required to change the larger and smaller punching units with each other when it is desired to punch larger holes after punching smaller holes, and vice versa. This job has been very troublesome and time-consuming and also dangerous since the punching units are very heavy and are to be placed on the high work table of a press.

Another disadvantage with the conventional punching unit has been the fact that is is very troublesome to replace punches and dies with others for desired sizes and shapes even when it is not needed to replace the whole punching unit with another larger or smaller one. It has been often required to pull forward the whole punching unit on the table of the press to change punches and dies.

Although there have been some means to overcome the abovementioned disadvantages, they have been costly, and it also has been often required to make a special machine in order to incorporate such a means.

SUMMARY OF THE INVENTION

It is the general object of the present invention to provide an improved punching unit which can be efficiently used to punch holes of a wide range of sizes in sheet materials.

It is a specific object of the present invention to provide a punching unit which is capable of holding both larger punches and dies for punching larger holes and smaller punches and dies for smaller holes.

It is another object of the present invention to provide a punching unit which can be easily changed over from a state for holding larger punches and dies for larger holes to a state for holding smaller punches and dies for smaller holes, and vice versa.

It is a further object of the present invention to provide a punching unit in which punches and dies can be easily replaced with others for desired sizes and shapes.

It is a still further and important object of the present invention to provide an improved punching unit which is economical in cost and can be used with conventional presses without any special machines.

Other and further objects and advantages of the present invention will be apparent from the following detailed description, which, by way of illustration, shows a preferred embodiment of the present invention and the principle thereof.

DESCRIPTION OF THE PREFERRED EMBODIMENTS

Figure 1:
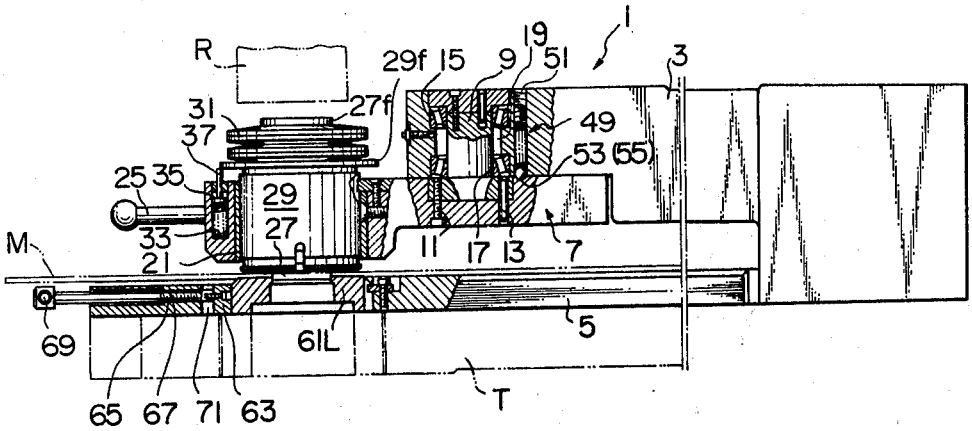
FIG. 1 is a side elevational view, partially in cross section, of a multiple tool holding punching unit according to the present invention.

Referring now to the accompanying drawings, the multiple tool holding punching unit according to the present invention generally designated by the numeral 1 is mounted on the table T of a press (not shown) and beneath the ram R of the same.

The punching unit 1 is of a generally C-shaped frame which has an upper arm 3 and a lower arm 5 both of which extend horizontally from an upright body portion. As seen from FIG. 2, the end of the upper arm 3 is formed laterally offset, and its free end terminates before the vertical line of the stroke of the ram R of the press, while the lower arm 5 is longer than the upper arm 3 to extend beyond the vertical line of the stroke of the ram R of the press. The sheet material M to be perforated is inserted between the upper and lower arms 3 and 5.

A punch holding member 7 is horizontally pivoted to the underside of the free end of the upper arm 3 by means of a rotatable shaft 9 secured therewith by suitable means such as bolts 11 and pins 13. The shaft 9 is rotatably supported by the upper arm 3 through taper roller bearings 15 and 17 forming therebetween an annular space 19.

Figure 2:
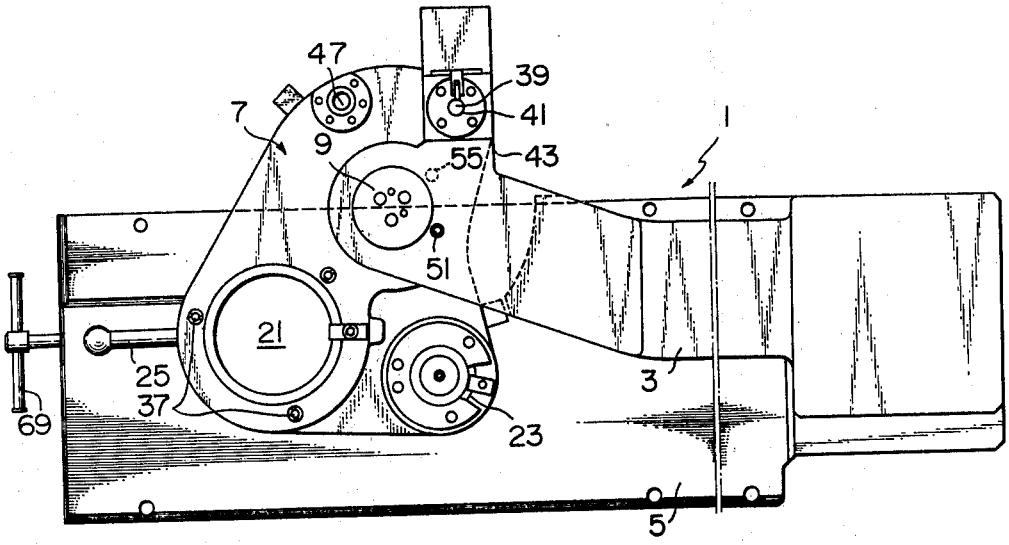
FIG. 2 is a plan view of the multiple tool holding punching unit shown in FIG. 1.

The punch holding member 7 is pivoted at its radial end with two vertical bores 21 and 23 which are circular for the purpose of holding punches of the same configuration and are different in diameter from each other. The punch holding bores 21 and 23 are to be located just beneath the ram R of the press and are so formed that their centers are arranged at an equal radial distance from the axis of the rotatable shaft 9. The larger bore 21 of the punch holding bores 21 and 23 is used to hold punches larger in diameter for punching larger holes in sheet materials, and the other smaller bore 23 is used to hold punches smaller in diameter for punching smaller holes. The punch holding member 7 can be horizontally rotated between the position as shown in FIG. 2 and that in FIG. 3 by means of a handle 25 secured thereto. Accordingly, either of the punch holding bores 21 and 23 can be placed at its working position just beneath the ram R of the press by rotating horizontally the punch holding member 7 about the shaft 9 with use of the handle 25. In FIG. 1, the larger punch holding bore 21 holding a larger punch is positioned at the punching position just beneath the ram R of the press.

Each of the punch holding bores 21 and 23 may hold punches in any conventional manner. In FIG. 1, it is shown that the larger punch holding bore 21 holds a larger punch 27 having a flanged head 27*f* together with its related elements which comprise a punch guide sleeve 29 having a flange 29*f* and encircling slidably the punch 27, a helical stripping spring 31 encircling the upper portion of the punch 27 and a plurality of helical lifter springs 33 each inserted in one of a plurality of vertical bores 35 provided around the punch holding bore 21. The lifter springs 33 bias upwardly the flange 29*f* of the guide sleeve 29 through a spring shoe 37 to hold the guide sleeve 29, the stripping spring 31 and the punch 27 at their raised position as shown in FIG. 1 to enable the sheet material M to be placed under the punch 27. The stripping spring 31 is compressed by the flanged head 27*f* when the punch 27 is depressed by the ram R of the press to punch holes in the sheet material M, and it strips the punch 27 from the sheet material M after each punching operation. The guide sleeve 29 can hold slidably any larger punches for punching larger holes, since the bodies of punches for larger holes are all of an equal diameter even if their lowermost punching bits or edges are different in size or shape according to the sizes or shapes of the holes to be punched in the sheet material M. The arrangement for smaller punches for punching smaller holes may be all the same as that for the larger punches, although the former is smaller in size than the latter.

In order to lock the punch holding member 7 so that each of the punch holding bores 21 and 23 may be positioned at its working station just beneath the ram R of the press, a shot pin 39 is movably provided in a vertical bore 41 formed through a horizontal projection 43 which is provided at the end of the upper arm 3, and also shot pin holes 45 and 47 for receiving the shot pin 39 arranged on the top of the punch holding member 7 at an equal radial distance from the axis of the rotatable shaft 9. The shot pin 45 is so arranged as to receive the shot pin 39 when the larger punch holding bore 21 is positioned at its working position just beneath the ram R of the press, while the shot pin hole 47 is designed to receive the shot pin 39 when the smaller punch holding bore 23 is located just beneath the ram R of the press. For the purpose of safety, the shot pin 39 can be connected with a suitable means such as a micro switch which is designed to deenergize the machine incorporating the punching device to make the machine inoperative when the shot pin 29 is not held by either of the shot pin holes 45 and 47.

Also, in order to easily position each of the punch holding bores 21 and 23 at its punching station just beneath the ram R of the press, a conventional click stop means 49 comprising a ball and a helical spring biasing the ball downwardly is provided in a vertical bore 51 formed through the end of the upper arm 3, and also two hollows 53 and 55 are provided on the upper surface of the punch holding member 7 at an equal radial distance with the click stop means 49 from the axis of the rotatable shaft 9 to cooperate with the click stop means 49. Each of the hollows 53 and 55 is so arranged as to receive the ball of the click stop means 49 when its corresponding punch holding bore 21 or 23 is positioned just beneath the ram R of the press.

A die holding bore 57 (FIG. 3) is vertically formed through the free end of the lower arm 5 to be located just beneath the ram R of the press and just beneath the place where the punch holding bores 21 and 23 are positioned to enable the punch to work. The die holding bore 57 is of a slot-like configuration of substantially oval shape having a major axis extending parallel to the longitudinal axis of the lower arm 5, and the center of the right-hand semi-circular portion of the die holding bore 57 as viewed in the drawings is arranged to align or coincide with the vertical line passing through the centers of the punch holding bores 21 and 23 positioned at the working position just beneath the ram R of the press.

A larger die 61L for punching larger holes is of a round shape which is slightly smaller in diameter than the semi-circle of the die holding bore 57 and it is put directly in the die holding bore 57 and is kept pushed rightwards as viewed in the drawings. The larger die 61L for punching larger holes is held pushed rightwards in the die holding bore 57 by a crescent shaped holding member 63 which has an arcuate holding surface having a radius substantially equal to that of the larger die 61L. The crescent shaped holding member 63 is designed to be horizontally moved in the die holding bore 57 toward and away from the die 61L by a lead screw 65 which is mounted in a threaded bore 67 horizontally formed at the end of the lower arm 5 and is provided at its end with a handle 69. A cresent shaped cut portion 71 is formed at the margin of the die holding bore 57 so that the crescent shaped holding member 63 may be suitably moved away from the die 61L to provide a space to facilitate assembly and disassembly of the die. Thus, the larger die 61L for punching larger holes can be tightly held in the die holding bore 57 by the crescent shaped holding member 63 by rotating the handle 69 so that it may be positioned just beneath the ram R of the press and its center may coincide with the vertical line passing through the axial center of the punch holding bore 21 or 23 placed at the punching position. Also, for the purpose of easy replacement of the dies, the die holding bore 57 is provided at its radially opposite margins with two crescent shaped notches 73 and 75 into which fingers can be put to hold the die.

Figure 3:
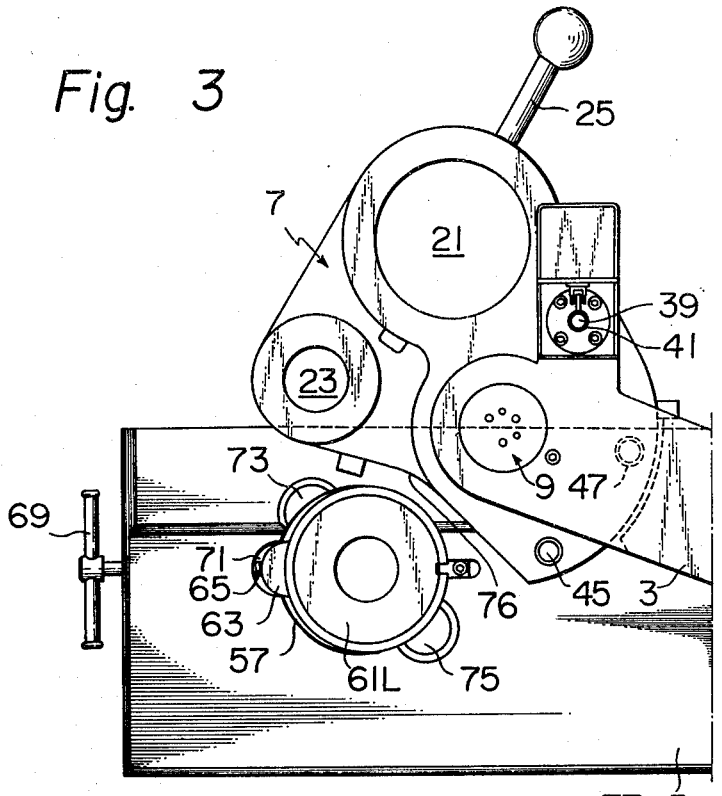
FIG. 3 is a fragmentary plan view similar to FIG. 2 but showing a movable element of the multiple tool holding punching unit as having moved away from the position shown in FIG. 2.
Figure 4:
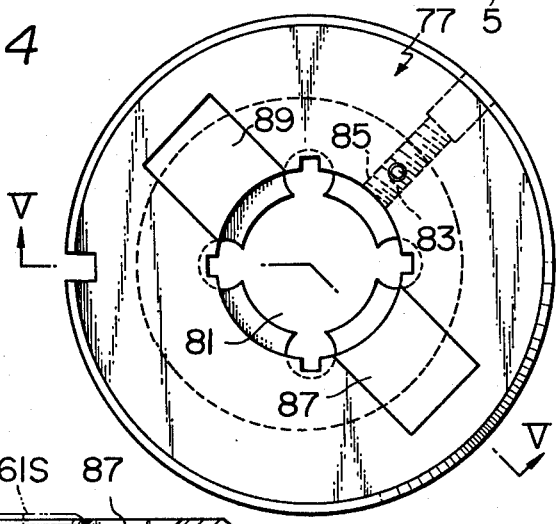
FIG. 4 is a plan view of an element of the multiple tool holding punching unit.
Figure 5:
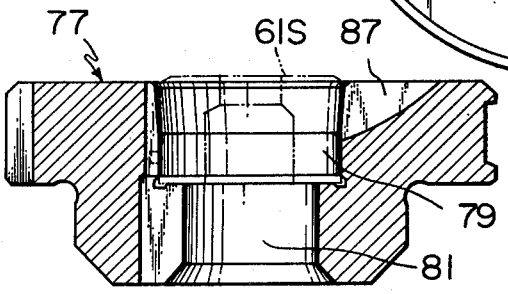
FIG. 5 is a sectional view taken on line V—V of FIG. 4.

To further facilitate replacement of the dies, the punch holding member 7 includes an inwardly curved sector 76 which does not overlay the die holding bore 57. Thus, as seen in FIG. 3, when the punch holding member 7 is rotated to bring the inwardly curved sector thereof into confronting relation with the die holding bore 57, the space above the bore 57 is unobstructed by the punch holding member 7 so that the die can be easily reached.

When it is desired to punch smaller holes in the sheet material M, a smaller die 61S for punching smaller holes is held in the die holding bore 57 by means of a smaller die holding adapter 77, since the smaller die 61S for punching smaller holes is much smaller in diameter than the larger die 61L for punching larger holes and the die holding bore 57. The smaller die holding adapter 77 is of a round shape which is just the same in diameter as the larger die 61L for punching larger holes and it is put in the die holding bore 57 just in the same manner as the larger die 61L for larger holes.

The smaller die holding adapter 77 is provided at its center with a vertical smaller die holding bore 79 which is slightly larger in diameter than the smaller die 61S for punching smaller holes to hold the same in itself and is provided at its lower portion with a slug discharging bore 81 for discharging the slugs coming from the punching operation. The smaller die 61S for smaller holes is mounted in the smaller die holding bore 79 of the die holding adapter 77 to rest on the shouldered portion surrounding the smaller diameter slug discharging bore 81 and it is fixedly held therein by a tightening screw 83 which is mounted in a threaded bore 85 radially formed in the smaller die holding adapter 77. In order to easily assemble and disassemble the smaller die 61S for smaller holes into and out of the smaller die holding bore 79, the smaller die holding adapter 77 is provided at its radially opposite portions with notches 87 and 89 into which fingers can be put.

In light of the above, it will be understood that the larger die 61L is directly held in the die holding bore 57 and is used with the larger punch held in the larger punch holding bore 21 having been positioned at the punching station just beneath the ram R of the press so as to punch larger holes in the sheet material M, while the smaller die 61S is held in the die holding bore 57 by means of the smaller die holding adapter 77 and is used with the smaller punch held by the smaller punch holding bore 23 having been positioned at the punching station to punch smaller holes.

Although the preferred embodiments of the present invention have been described and illustrated as being capable of holding only two groups of punches and dies which are of two ranges of sizes, large and small, the multiple tool holding punching unit according to the present invention can be designed to hold additional ranges of tools as well. For instance, it is possible to provide the punch holding member 7 with more punch holding bores than described herein and provide more smaller die holding adapters each of which is the same in diameter as the smaller die holding adapter 77 but has a die holding bore different in diameter from the smaller die holding bore 79 of the smaller die holding adapter 77.

As has been so far described, the multiple tool holding punching unit according to the present invention is so designed that it can be installed with both of larger tools and smaller tools which are used for punching larger holes and smaller holes, respectively. Accordingly, the multiple tool holding punching unit according to the present invention can be very advantageously used to punch various holes of a wide range of sizes in sheet materials.

Either of the punch holding bores 21 and 23 for holding larger punches and smaller punches respectively can be easily positioned at its punching station just beneath the ram R of the press only by rotating the punch holding member 7 by means of the handle 25 until the click stop means 49 will engage the hollow 53 or 55. Since each of the punch holding bores 21 and 23 can be easily displaced from under the ram R of the press by horizontally rotating the punch holding member 7, the punches can be easily inserted or removed from the punch holding bore 21 and 23 without any obstruction of the ram R of the press. Also, since any punches held by the punch holding bores 21 or 23 need not be brought into contact with the upper arm 3 in any case, any of the punch holding bores 21 and 23 can hold a punch while the other punch holding bore holds another punch, and accordingly it is not necessary to remove the punch from any of the punch holding bores 21 and 23 when it is desired to use the other punch holding bore. Since any punches held by the punch holding member 7 can be rotated under the upper arm 3, the whole multiple tool holding punching unit according to the present invention can be made shorter in height than prior art units, and thus it is mechanically advantageous and can be mounted on presses having a throat short in height. Additionally, the shot pin 39, which locks the punch holding member 7 so that the punch holding bores 21 and 23 may be located at their working position, can be automatically put inserted and removed from the shot pin holes 45 and 47 in any suitable conventional manner using hydraulic or pneumatic fluid.

Since the punch holding member 7 can be easily rotated away from its position above the die holding bore 57 as shown in FIG. 3, the die 61L or 61S can be easily inserted or removed from the die holding bore 57. Also, the die 61L or 61S can be easily held fixed only by tightening the screw 65 by means of the handle 69.

In addition to the above described advantages, the multiple tool holding punching unit according to the present invention is of a simple construction which can be economically manufactured, and also it can be easily mounted on any conventional presses and accordingly it does not need any special machine.

Although the preferred forms of the present invention have been illustrated and described, it should be understood that the device is capable of modification by one skilled in the art without departing from the principles of the invention. Accordingly, the scope of the invention is to be limited only by the literal interpretation of the claims appended hereto.

I claim:

1. A punching unit comprising a horizontally extending upper arm having a punch holding member pivotally mounted thereon about a vertical axis, said member including a plurality of punch holding bores, a horizontally extending lower arm having a die holding bore formed therein, means for rotating said punch holding member about said axis to index selected ones of said punch holding bores into overlaying registry with said die holding bore, said punch holding member having a configuration defining a sector which does not overlay said die holding bore throughout a given angular extent of the rotation thereof thereby facilitating removal and replacement of dies in said die holding bore, said upper arm having a main body portion connected to and extending generally parallel to said lower arm, and a free end laterally offset from said main body portion, said punch holding member being mounted on said free end.

2. A punching unit as defined in claim 1, wherein said punch holding member is mounted on a rotatable shaft.

3. A punching unit as defined in claim 1, wherein said sector of said punch holding member is inwardly curved.

4. A punching unit as defined in claim 1, wherein said punch holding bores are of different diameters.

5. A punching unit comprising a horizontally extending upper arm having a punch holding member pivotally mounted thereon about a vertical axis, said member including a plurality of punch holding bores, a horizontally extending lower arm having a die holding bore formed therein, means for rotating said punch holding member about said axis to index selected ones of said punch holding bores into overlaying registry with said die holding bore, said punch holding member having a configuration defining a sector which does not overlay said die holding bore throughout a given angular extent of the rotation thereof thereby facilitating removal and replacement of dies in said die holding bore, said die holding bore having a slot-like configuration of substantially oval shape, and a clamping member received in a recess in a wall of said bore and horizontally movable into said die holding bore for securing a die therein.

6. A punching unit as defined in claim 5, wherein said punch holding member is mounted on a rotatable shaft.

7. A punching unit as defined in claim 5, wherein said sector of said punch holding member is inwardly curved.

8. A punching unit as defined in claim 5, wherein said punch holding bores are of different diameters.

* * * * *

UNITED STATES PATENT AND TRADEMARK OFFICE

CERTIFICATE OF CORRECTION

PATENT NO. : 3,985,056

DATED : October 12, 1976

INVENTOR(S) : Moichi Oseto

It is certified that error appears in the above-identified patent and that said Letters Patent are hereby corrected as shown below:

In the Foreign Application Priority Data [30], change "50-8767" to --18767/1975--;

Column 1, line 17, change "gnerally" to --generally--;

Column 3, line 57, change "29" to --39--;

Column 6, line 15, after "automatically" delete "put".

Signed and Sealed this

Twenty-ninth Day of March 1977

[SEAL]

*Attest:*

RUTH C. MASON
*Attesting Officer*

C. MARSHALL DANN
*Commissioner of Patents and Trademarks*